US007832241B2

(12) United States Patent
Mantovan

(10) Patent No.: US 7,832,241 B2
(45) Date of Patent: Nov. 16, 2010

(54) DEVICE AND METHOD FOR ALIGNING THE INPUT APPARATUSSES AND THE CHANNELS IN A ROLLING STAND

(75) Inventor: Gianfranco Mantovan, Busto Arsizio-Varese (IT)

(73) Assignee: Siemens VAI Metals Technologies S.r.l., Marnate (VA) (IT)

( * ) Notice: Subject to any disclaimer, the term of this patent is extended or adjusted under 35 U.S.C. 154(b) by 859 days.

(21) Appl. No.: 11/663,785

(22) PCT Filed: Oct. 28, 2005

(86) PCT No.: PCT/EP2005/011633

§ 371 (c)(1),
(2), (4) Date: Mar. 23, 2007

(87) PCT Pub. No.: WO2006/045629

PCT Pub. Date: May 4, 2006

(65) Prior Publication Data

US 2008/0053176 A1 Mar. 6, 2008

(30) Foreign Application Priority Data

Oct. 29, 2004 (IT) ..... MI2004A2060

(51) Int. Cl.
*B21B 37/58* (2006.01)
*B21B 38/00* (2006.01)

(52) U.S. Cl. ..... 72/10.7; 72/31.08

(58) Field of Classification Search ..... 72/10.1, 72/10.7, 12.1, 13.4, 31.07–31.09; 33/657
See application file for complete search history.

(56) References Cited

U.S. PATENT DOCUMENTS

| | | | | | |
|---|---|---|---|---|---|
| 2,368,129 | A | * | 1/1945 | Fors et al. | 33/657 |
| 3,646,686 | A | * | 3/1972 | Kreiskorte | 33/657 |
| 3,834,820 | A | | 9/1974 | Bock | |
| 4,059,794 | A | * | 11/1977 | Furness et al. | 33/657 |
| 4,067,115 | A | * | 1/1978 | Beaton | 33/657 |
| 4,131,004 | A | * | 12/1978 | Eibe | 33/657 |
| 4,171,577 | A | * | 10/1979 | Meyer et al. | 33/657 |
| 4,821,544 | A | * | 4/1989 | Tamler et al. | 72/14.1 |
| 5,533,371 | A | * | 7/1996 | Frischknecht et al. | 33/657 |
| 6,214,518 | B1 | | 4/2001 | Kunita et al. | |

FOREIGN PATENT DOCUMENTS

| | | |
|---|---|---|
| GB | 2022286 | 12/1979 |

OTHER PUBLICATIONS

International Search Report, Dec. 21, 2005.

* cited by examiner

*Primary Examiner*—Dana Ross
*Assistant Examiner*—Mohammad Yusuf
(74) *Attorney, Agent, or Firm*—Laurence A. Greenberg; Werner H. Stemer; Ralph E. Locher

(57) ABSTRACT

A device for aligning the input apparatuses and the channels in a rolling stand is characterized in that it comprises: a measurement instrument (20) equipped with means (22, F, 23) for detecting the position of the surfaces of the channels (4), at least one electronic sensor (24) suitable for receiving such position detection and instrumentation for displaying the detection and its processing, and for providing the detected position.

8 Claims, 7 Drawing Sheets

DEVICE AND METHOD FOR ALIGNING THE INPUT APPARATUSSES AND THE CHANNELS IN A ROLLING STAND

The present invention refers to a device and method for aligning the input apparatuses and the channels in the rolling stands.

Rolling plants for long products, for example round bars for different uses, comprise a series of rolling stands, arranged in sequence. In FIGS. 1 and 2 a stand in front view and a detail thereof are respectively schematised.

Each stand 1 is equipped with two rolling cylinders or rollers 2, 3, one top one bottom, on which the channels 4 are formed.

The rolled material passing through the aforementioned channels 4 is deformed according to the profile of the channel itself.

The channel is formed in two half-grooves 4' and 4", the first of which is formed in the top roller 2 and the second in the bottom roller 3.

With reference to FIG. 3 it is illustrated how, at the input of each stand, the rolled material 5, coming from a previous stand, is guided and directed into the work channel through a suitable input apparatus 6.

The system comprising the rolling stand complete with grooved rollers and the relative input apparatuses is foreseen to make, at the output of the stand itself, a rolled material of desired shape and size, and with narrow tolerances.

For such a purpose it is necessary that:

- the guide apparatus of the rolled material entering into the stand be perfectly centred and coaxial with the axis of the channel;
- the groove formed on the top cylinder must be perfectly centred on the groove formed on the bottom cylinder.

The top cylinder is axially adjustable with respect to the bottom cylinder, and the distance between the two cylinders is symmetrically adjustable with respect to the centre of the channel.

The aforementioned distance must be precalibrated at a precise measurement to take into account the elastic yielding of the machine under the deformation load in order to obtain the required size.

Currently, the aforementioned alignments are carried out by the eye of the operator, according to his experience or with the use of optical instruments or video cameras.

These systems do not allow a relative alignment of the two grooves and of the input guide apparatuses to be obtained with the required precision to obtain products with narrow tolerances.

The input guide apparatus is mounted on a slide held in position by guides at 45° and by a central key. The assembly is mounted on a guide support fixed to the structure of the stand.

Through a screw and lead nut system, the slide can be translated in the longitudinal direction to centre the apparatus in the centre of the channel.

The general purpose of the present invention is, therefore, that of providing a device that allows an alignment of the grooves forming the passage channel of the rolled material to be obtained.

Another purpose of the present invention is that of making a device that allows the measurement of the position of the input apparatus-carrying slide with respect to the centre of the rolling channel.

The last but not least purpose of the present invention is that of providing a method for aligning the input apparatuses and the channels in a rolling stand.

In view of the aforementioned purposes, according to the present invention, it has been thought of to make a device for aligning the input apparatuses and the channels in a rolling stand having the characteristics outlined in the attached claims.

The structural and functional characteristics of the present invention as well as its advantages compared to the prior art shall become even clearer from an examination of the following description, referring to the attached drawings, which show an alignment device made according to the innovative principles of the invention itself.

In the drawings:

FIGS. 1 to 3 refer to a rolling stand according to the prior art;

FIGS. 4*a* and 4*b* illustrate, in a schematic and partially sectioned side view, the device according to the present invention in two different operating positions;

Figure 7:
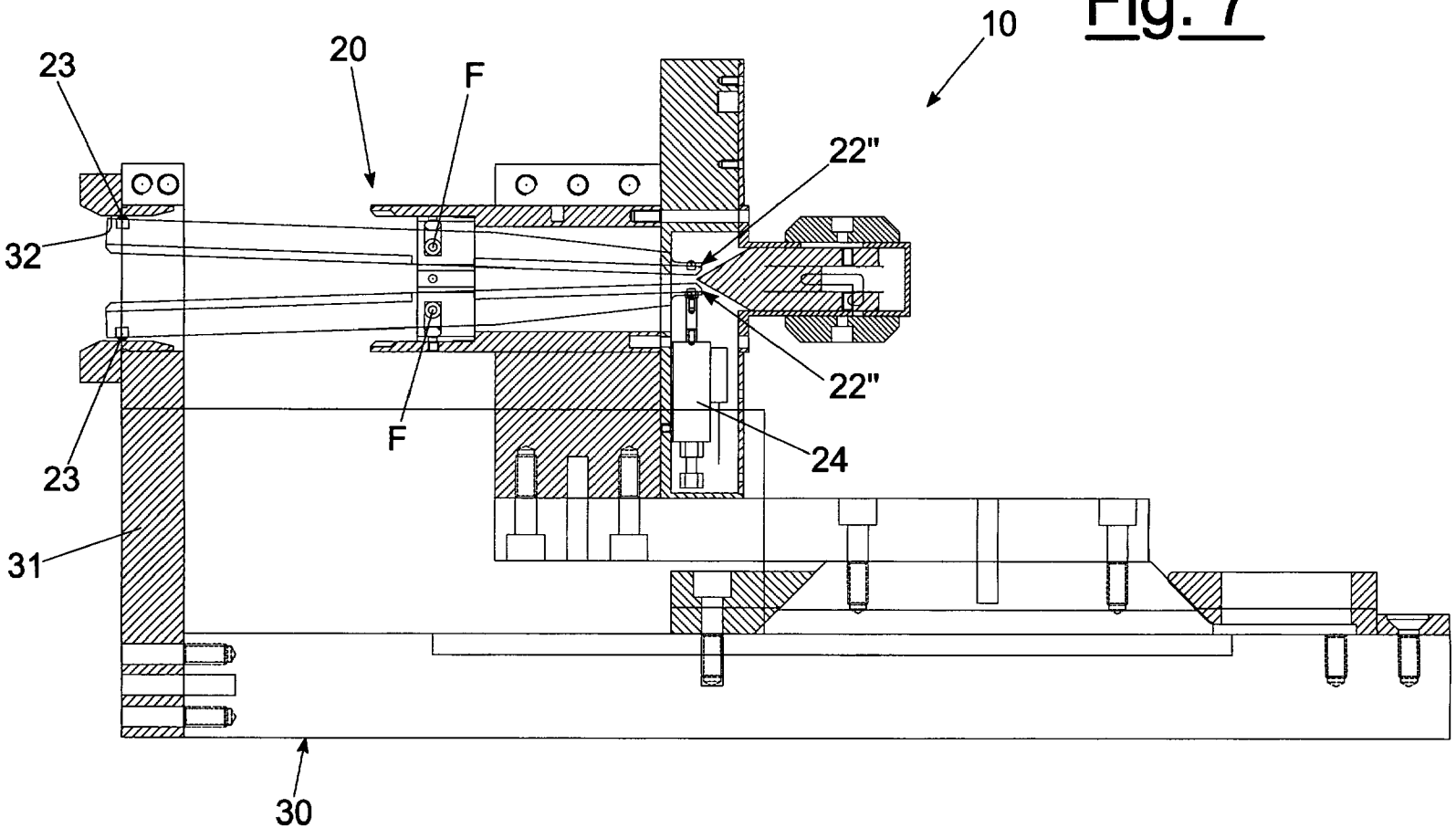

FIG. 7 schematically illustrates a side section view of a calibrating table of the instrument according to the invention.

With reference to FIGS. 4*a* to 7, a device 10 for aligning the input apparatuses and the channels in a rolling stand 1 comprises a measuring instrument 20 comprising a base structure 21 suitable for being mounted on the slide 13, carrying the input apparatus of the rolling stand, through a key in place of the input guide apparatus 5 (FIG. 3) of the stand.

Figure 1:
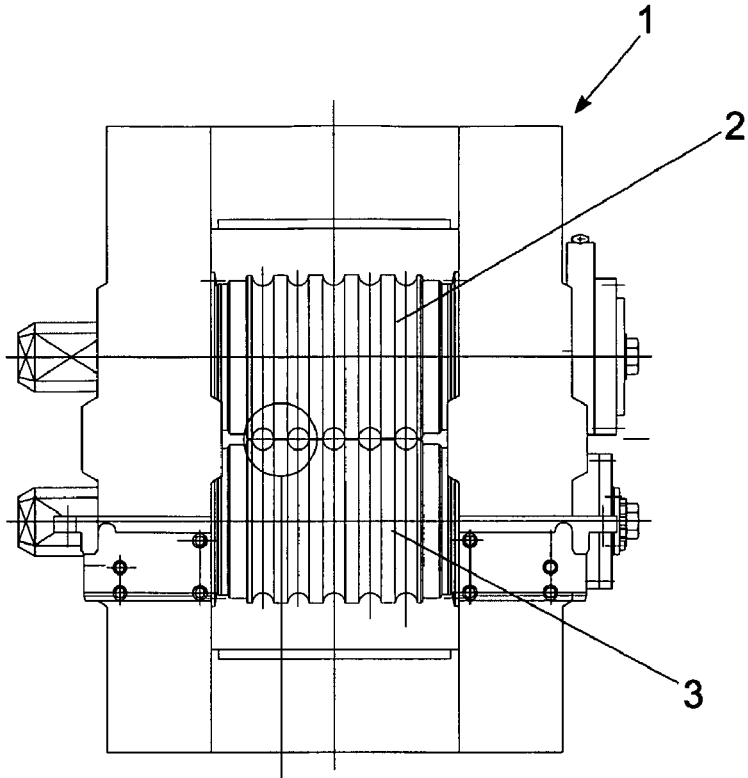
Fig. 1 PRIOR ART
Figure 2:
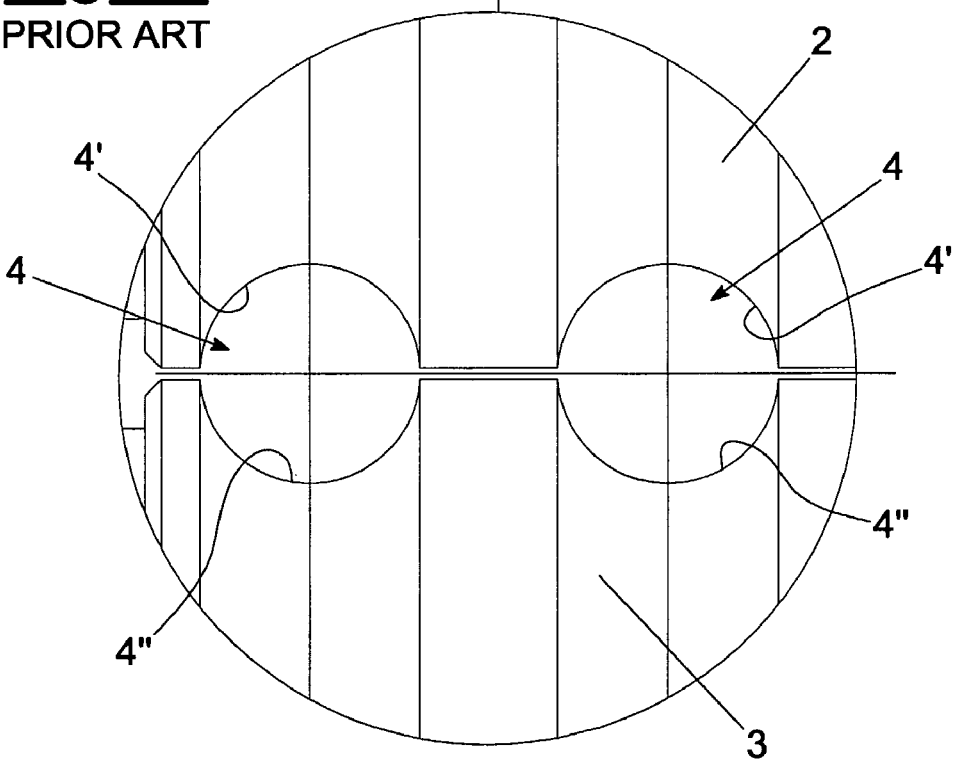
Fig. 2 PRIOR ART
Figure 3:
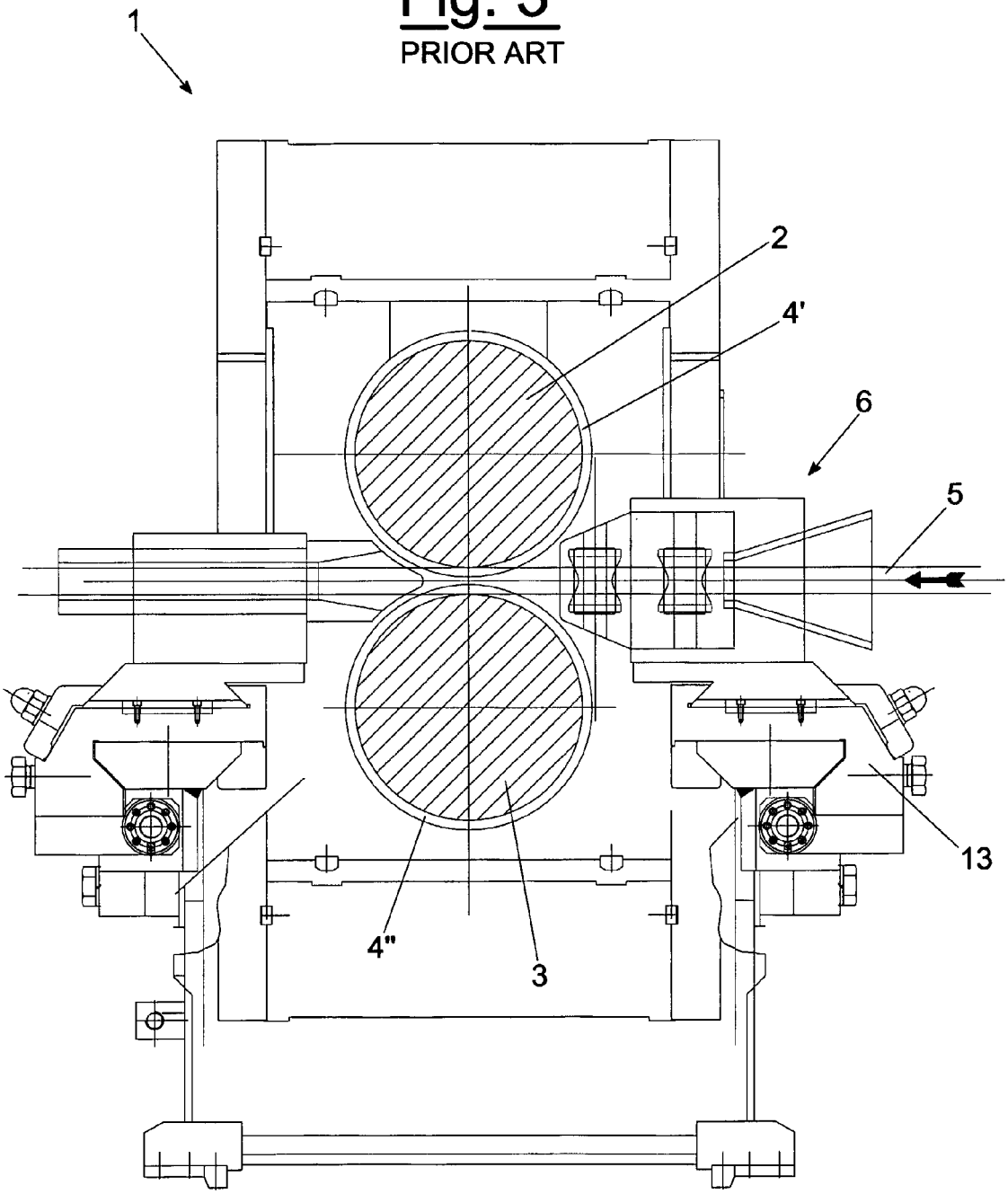
Fig. 3 PRIOR ART
Figure 4A:
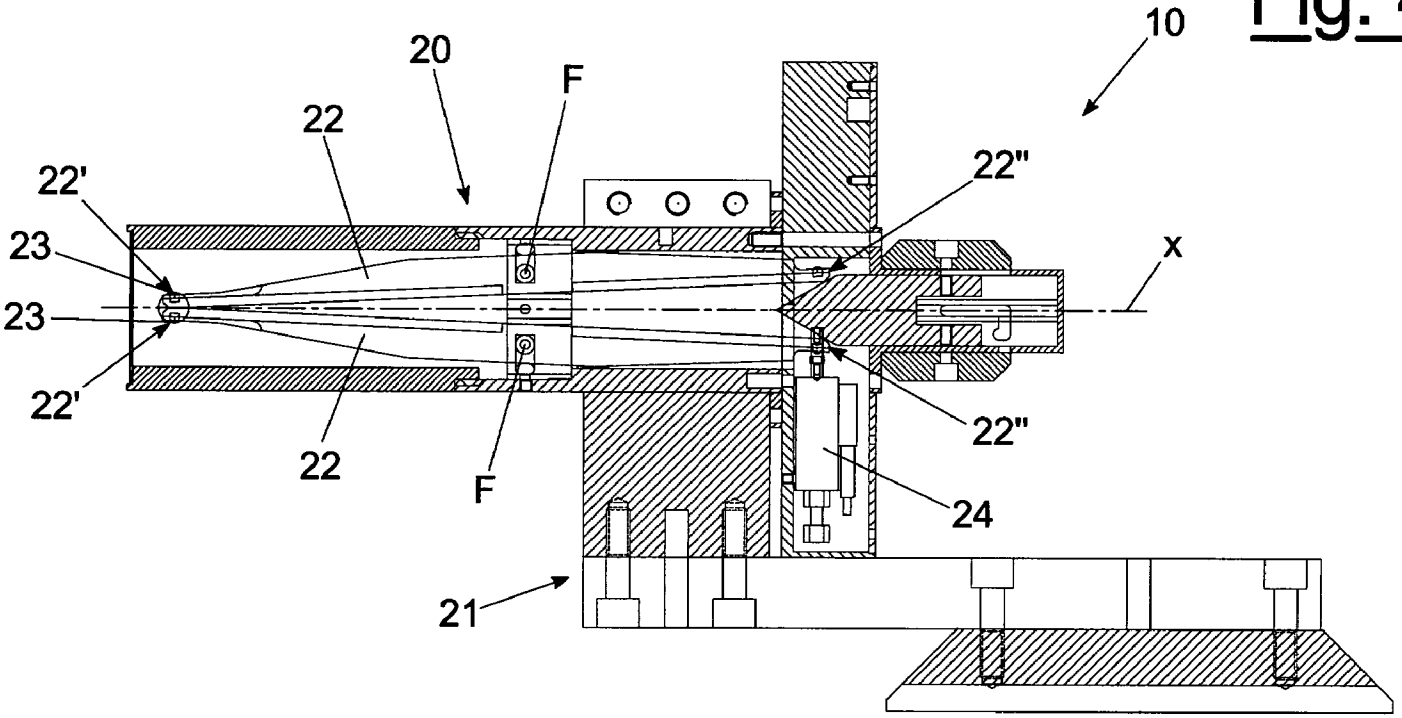
Figure 4B:
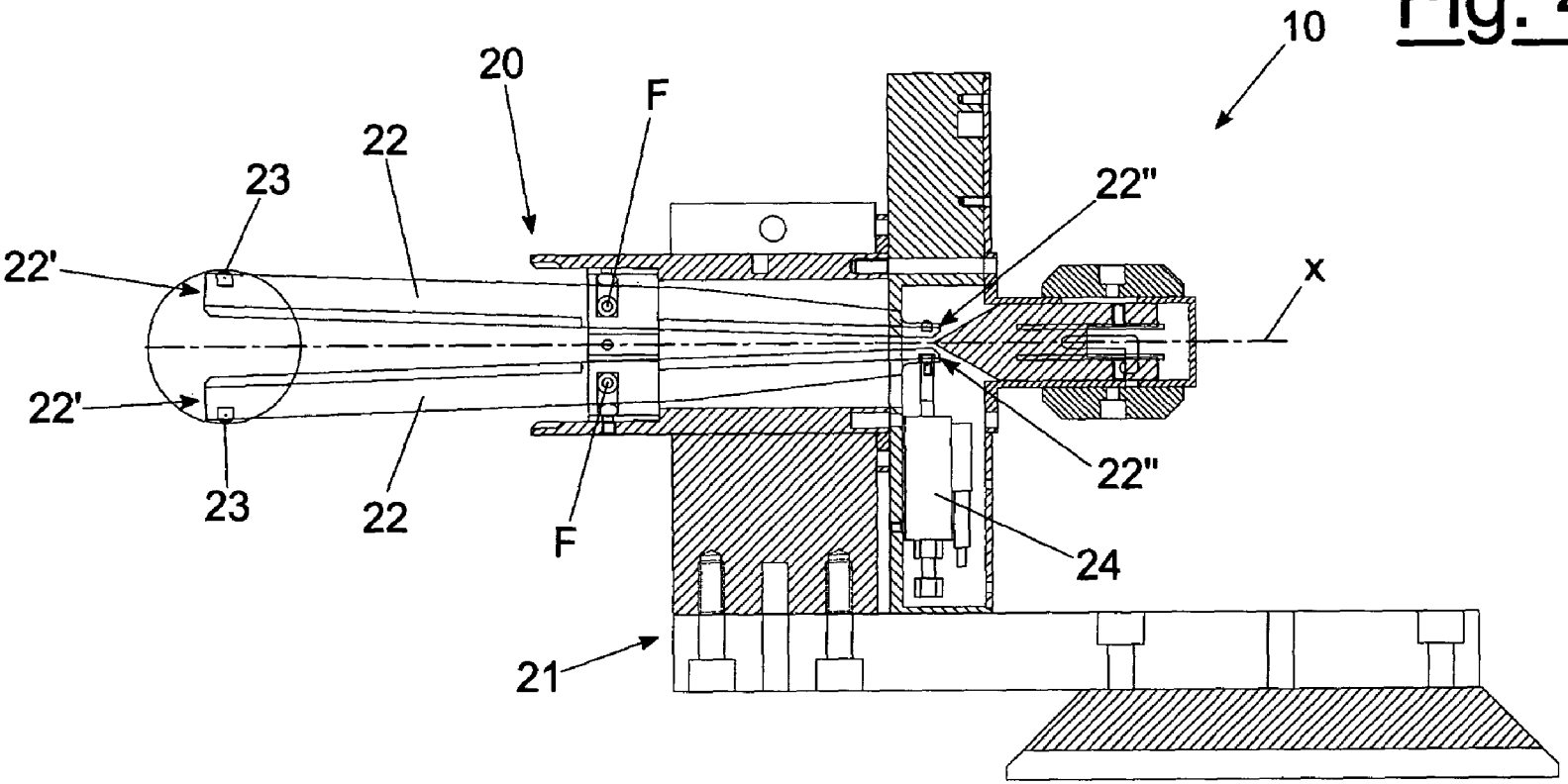
Figure 5:
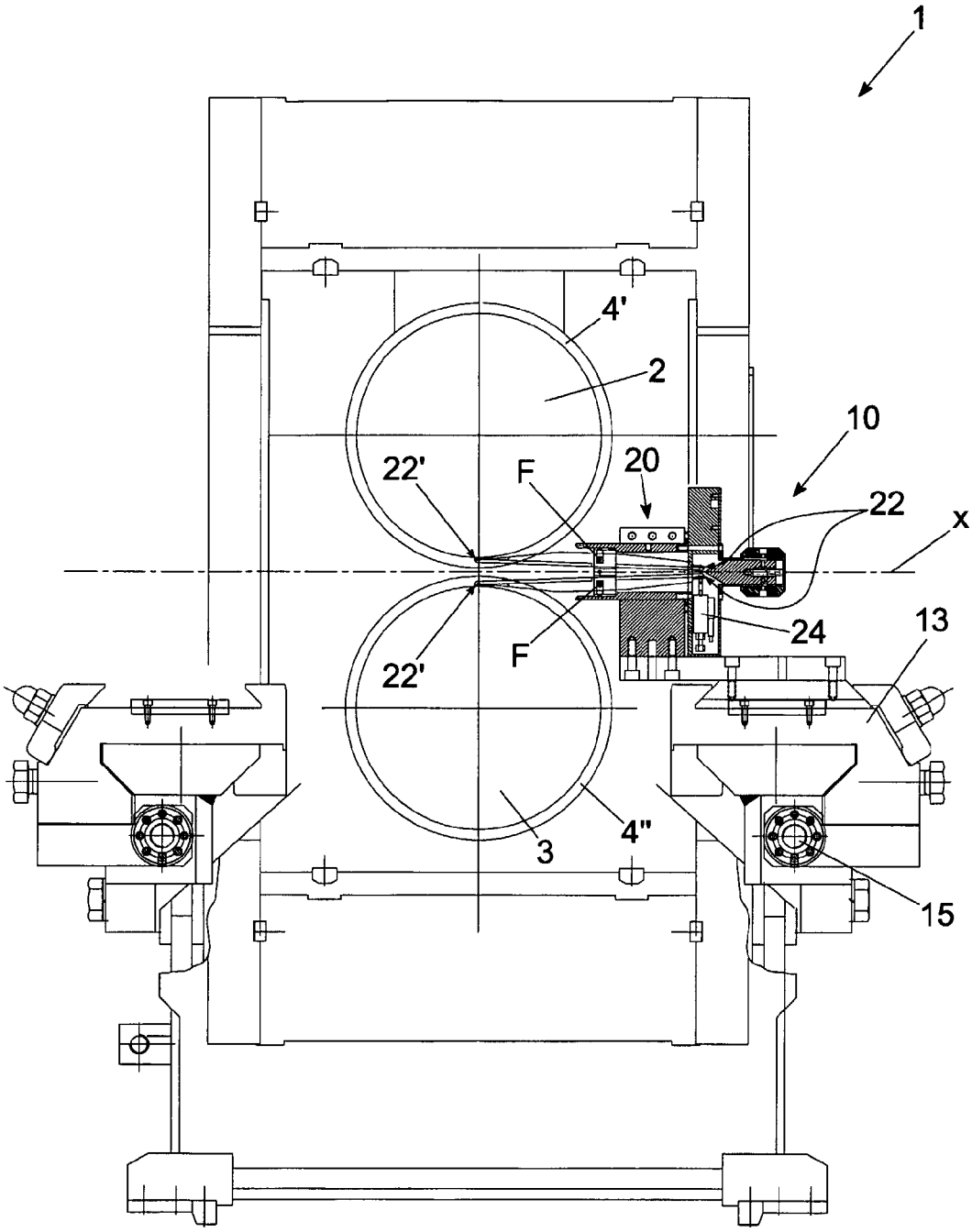
FIG. 5 is a schematic side section of the device according to the invention mounted at the input of a rolling stand.
Figure 6:
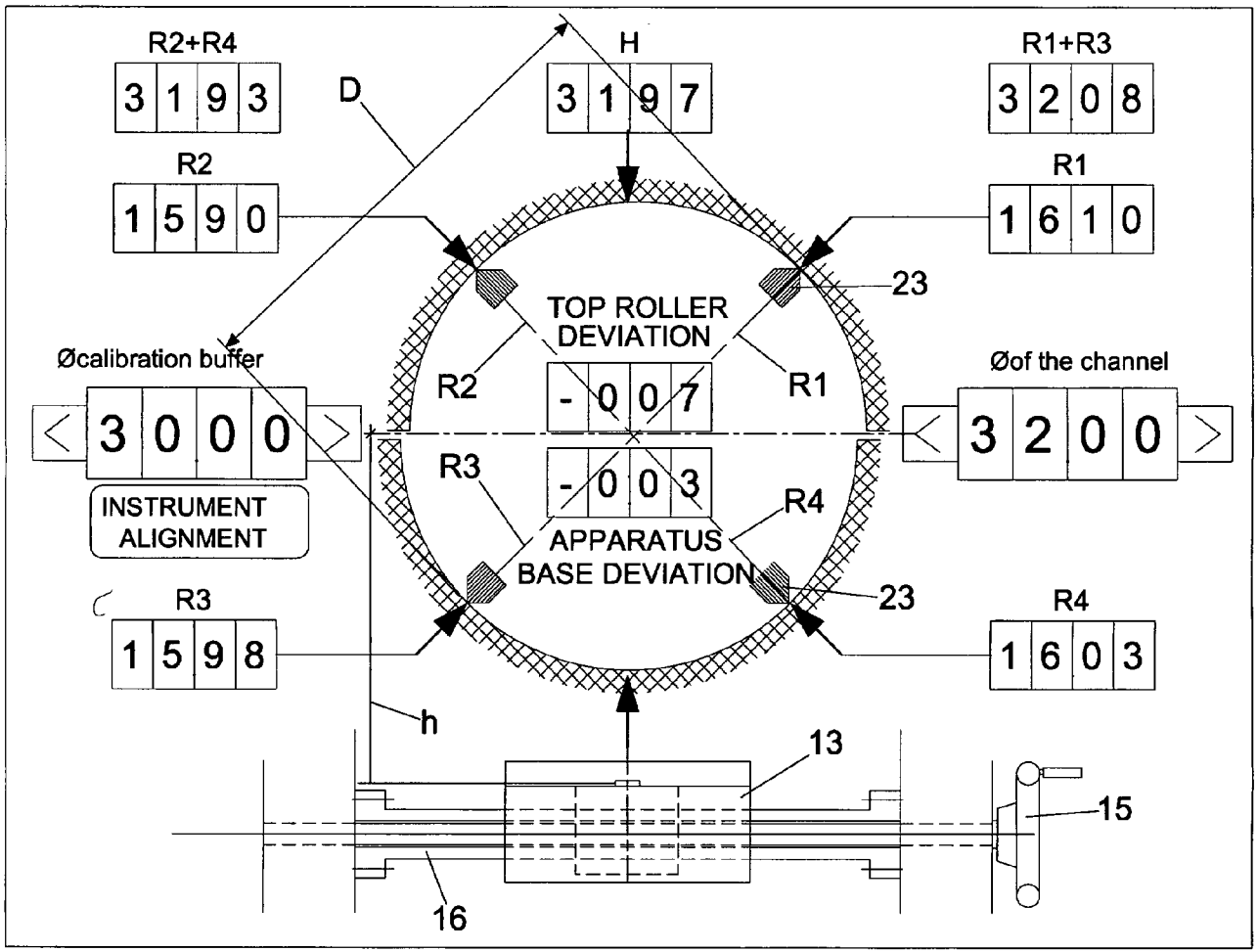
FIG. 6 is a schematic representation exemplifying a measurement of the instrument according to the invention.

It should be noted that the rolling stand, to which the device according to the invention is applied, has identical reference numerals for the elements common to the stand according to the prior art according to FIGS. 1-3.

The instrument also comprises four shafts 22, each pivoted through a pin F so as to be able to oscillate about said pin. Such shafts in operating measurement state are inclined, by an angle $\alpha$ with respect to the horizontal.

An end 22' of each shaft 22 carries a push rod 23 suitable for making contact with the surface of one of the grooves 4' or 4" that constitute the rolling channel 4.

In such a way, the push rod 23 detects the position of the surface of the groove.

The opposite end 22" of each shaft, actuates an electronic sensor 24 that, through a suitable calculation algorithm, provides the value of the position of each surface with respect to the centre of the instrument.

The four shafts 22 can each oscillate independently about its pivot F, so as to carry out independent measurements of the position of the groove surface 4', 4" to be controlled with respect to the centre of the instrument.

The shafts 22 in practice behave like levers, which can be of the first, second or third type.

To make the slide 13 translate along a slide-carrying base 16, one acts on a ball crank handle 15.

Through the device according to the invention the following measurements are carried out:

- diameter D of the channel 4;
- height h from the central detection axis X of the instrument to the support plane;
- four rays R1-R4 between the surfaces of the grooves and the central detection axis of the instrument, the rays R1, R2 referring to the surface of the top groove 4' and the rays R3, R4 referring to the surface of the bottom groove 4", respectively.

The centering method therefore foresees the steps of:

a) Arranging and mounting the device 10 in place of the input apparatus to the rolling stand;

b) opening wide the shafts until the contact of the push rods 23 with the surfaces of the grooves 4' and 4";

c) detecting the four rays R1-R4 between the surfaces of the grooves 4' and 4" and the central detection axis X of the instrument;

d) controlling the equality between the rays R3 and R4;

e) displacing the slide 13 acting on the ball crank handle 15 until R3=R4 is obtained, in the case in which R3 is different to R4, in such a way obtaining the centering key of the stands input apparatus, perfectly centred with the groove 4" of the bottom roller 3;

f) controlling the equality between R1 and R2;

g) displacing the top roller 2 through suitable mechanisms of the rolling stand, to centre the top groove with the bottom one should R2 be different to R1;

h) checking that the opening H is at the value foreseen by the rolling conditions, said opening being calculated through geometric relationships by reading of the rays R1-R4 in relation to the ray of the known channel;

i) proceeding to the adjustment open or closed of the two rollers 2, 3 if there is a difference of reading;

l) adjusting the height of the slide-carrying slides 16, should the values of the rays R1 and R4 or else R2 and R3 not be equal to each other;

m) dismounting the device 10;

n) remounting the input apparatus in the stand.

The precalibration of the system is thus obtained, with the required precision, which fall within tolerance values of 0.01 mm more or less.

An inspection table 30 allows the necessary calibrations for zeroing the measurement instruments to be carried out, being equipped with an upright 31 with a calibration channel 32.

The invention claimed is:

1. A device for aligning input apparatuses and channels in a rolling stand, comprising:

a measurement instrument equipped with means for detecting a position of a surface of a channel, the means for detecting a position including:

four inclined shafts, each pivoted through a pin so as to be able to oscillate about said pin;

an end of each shaft carrying a push rod suitable for making contact with a surface of a groove constituting a channel, to detect a position of the surface of the groove with respect to a central axis of the measurement instrument;

at least one electronic sensor for obtaining the detected position of the surface of the groove; and instrumentation for displaying the detected position and a processing of the detected position.

2. The device of claim 1, wherein said four inclined shafts are arranged to each oscillate independently about its pivot, so as to carry out independent measurements of the position of the groove surface.

3. The device of claim 1, wherein said device comprises a base structure suitable for being mounted on the slide that carries the input apparatuses of the rolling stand, through a key in the place of the input guide apparatus of the rolling stand.

4. The device of claim 3, wherein said device comprises a ball crank handle suitable for making the slide translate along a slide-carrying base, the slide-carrying base being height-adjustable.

5. A method for aligning input apparatuses and channels in a rolling stand, comprising the steps of:

a) arranging and mounting a device in place of an input apparatus to the rolling stand, the device including:

a measurement instrument equipped with means for detecting a position of a surface of a channel, the means for detecting a position including:

four inclined shafts, each pivoted through a pin so as to be able to oscillate about said pin;

an end of each shaft carrying a push rod suitable for making contact with a surface of a groove constituting a channel, to detect a position of the surface of the groove with respect to a central axis of the measurement instrument;

at least one electronic sensor for obtaining the detected position of the surface of the groove; and instrumentation for displaying the detected position and a processing of the detected position;

b) opening wide the shafts until each push rod contacts a surface of a groove;

c) detecting the four rays R1, R2, R3, R4 between the surfaces of the grooves and the central detection axis of the instrument, the rays R1, R2 referring to a top groove and the rays R3, R4 referring to a bottom groove of the channel, respectively;

d) controlling an equality between the ray R3 and the ray R4;

e) displacing a slide acting on a ball crank handle until the ray (R3) is made equal to the ray (R4), in a case in which the ray (R3) is different from the ray (R4), in such a way obtaining a centering key of the stands input apparatus, perfectly centered with a groove of a bottom roller;

f) controlling an equality between the ray R1 and the ray R2;

g) displacing a top roller through suitable mechanisms of the rolling stand, to center the top groove with the bottom groove should the ray R2 be different from the ray R1;

h) checking that an opening is at the value foreseen by the rolling conditions, the opening being calculated through geometric relationships by the reading of the rays R1, R2, R3, R4 in relation to a ray of a known channel;

i) proceeding to the adjustment of the top and bottom rollers if there is a difference of reading;

j) adjusting a height of a slide-carrying base, should the values of the rays R1, R4, or R2, R3, not be equal to each other;

k) dismounting the device;

l) remounting the input apparatus in the stand.

6. The method of claim 5, wherein the four inclined shafts are arranged to each oscillate independently about its pivot, so as to carry out independent measurements of the position of the groove surface.

7. The method of claim 5, wherein the device comprises a base structure suitable for being mounted on the slide that carries the input apparatuses of the rolling stand, through a key in the place of the input guide apparatus of the rolling stand.

8. The method of claim 7, wherein the device comprises a ball crank handle suitable for making the slide translate along the slide-carrying base, the slide-carrying base being height-adjustable.

* * * * *